US005366007A

United States Patent [19]

Hutto et al.

[11] Patent Number: 5,366,007

[45] Date of Patent: Nov. 22, 1994

[54] TWO-PIECE HEADER

[75] Inventors: Scott L. Hutto; John M. McCrady, both of Burleson, Tex.

[73] Assignee: Wynn's Climate Systems, Inc., Ft. Worth, Tex.

[21] Appl. No.: 102,694

[22] Filed: Aug. 5, 1993

[51] Int. Cl.[5] ..... F28F 9/02

[52] U.S. Cl. ..... 165/173; 165/153; 165/178

[58] Field of Search ..... 165/153, 173, 176, 177, 165/178

[56] References Cited

U.S. PATENT DOCUMENTS 3,113,615 12/1963 Huggins .
3,223,155 12/1965 Hubbard ..... 165/176
3,866,675 2/1975 Bardon et al. .
4,215,745 8/1980 Tuckmantel ..... 165/176 X
4,903,389 2/1990 Wolf .
4,917,180 4/1990 Wolf et al. .
4,938,284 7/1990 Howells .
4,971,145 11/1990 Lyon .
5,052,477 10/1991 Nakajima et al. .
5,052,478 10/1991 Nakajima et al. .
5,052,480 10/1991 Nakajima et al. .
5,062,476 11/1991 Ryan et al. ..... 165/153 X
5,107,926 4/1992 Calleson .
5,125,454 6/1992 Creamer et al. .
5,127,466 7/1992 Ando .
5,152,339 10/1992 Calleson .
5,168,925 12/1992 Suzumura et al. .
5,172,762 12/1992 Shinmura et al. .
5,186,248 2/1993 Halstead ..... 165/173
5,236,042 8/1993 Kado ..... 165/173 X
5,251,694 10/1993 Chigira ..... 165/173

*Primary Examiner*—Stephen M. Hepperle
*Attorney, Agent, or Firm*—James E. Bradley; Grady K. Bergen

[57] ABSTRACT

A heat exchanger has a pair of headers which are formed from only two components. Each header is formed from a header channel which has an open portion which extends along the length of the header channel. Grooves are formed on either side of the open portion for receiving a header plate. The header plate is formed with a series of holes extending along the length of the plate. A fluid partition and end caps are formed from a folded portion of the header plate to direct fluid flow through the header pipe. The header plate is inserted into the header channel by inserting the side edges of the header plate into the grooves and sliding the header plate from one end of the header channel to the other so that the header plate extends over the open portion with the fluid partition and end caps protruding across and blocking the interior of the header channel. In an alternate embodiment, two header plates having end caps at each end are positioned within the header channel. The end caps located in the interior of the header channel form partitions for diverting flow.

18 Claims, 5 Drawing Sheets

TWO-PIECE HEADER

BACKGROUND OF THE INVENTION

1. Field of the Invention

This invention relates to a parallel flow heat exchanger and in particular, to headers constructed in two parts and including a partition for diverting fluid flow through at least one of the headers.

2. Description of the Prior Art

Typically, parallel flow heat exchangers, such as those used in air conditioning condensers, consist of a set of parallel cross-flow tubes disposed between a pair of headers. The tubes are open at both ends and joined to the headers so that highly pressurized fluid may flow from one header to another. In order to conserve space while providing a large amount of surface area for heat transfer, several banks of tubes are used to pass the fluid back and forth between the headers. Fluid partitions are usually located within the headers for directing the fluid, within the heat exchanger, through the banks or series of tubes. By providing one or more fluid partitions in each header, the fluid flows through the heat exchanger in a serpentine manner, flowing in one direction through one bank of tubes and in the opposite direction in another bank of tubes.

Most prior art headers consist of a tubular member with holes or slots in the member for inserting the cross-flow tubes. Partition plates must also be inserted within the header requiring further alteration of the tubular member.

To remedy the problems of forming holes in the tubular member, some headers have been constructed in two parts. A header having an open face is extruded as a single piece. A separate plate is then manufactured with the holes being punched or stamped into the plate. The plate is then positioned over the open portion of the header, and the two pieces are then welded or brazed together to form a single tubular header through which the ends of the tubes can be inserted.

While these two-part headers are an improvement, the headers must still be altered in order to accommodate fluid partitions and end caps. Slots are usually cut into the header to accommodate the partition plate which can sometimes weaken the structural integrity of the header.

A need exists for a header in a parallel flow heat exchanger, such as those used in air conditioning condensers, that is assembled from a minimum number of components and includes end caps and fluid partitions and that can be assembled without substantial alterations.

SUMMARY OF THE INVENTION

A parallel flow heat exchanger has a pair of headers that are easy to assemble and require a minimum number of components. Each header is made from a header channel that has a hollow interior and a longitudinally extending open portion which extends along the full length of the header channel from opposite first and second ends.

Along opposite sides of the open portion of each header channel is a pair of longitudinally extending grooves for securing a one-piece header plate. A set of parallel cross-flow tubes are inserted into holes formed in the header plate for conducting fluid from one header to another. The header plate has a fluid partition formed from a folded portion of the plate which projects within and blocks the interior of the header for diverting fluid flow through the header and into the tubes.

Each header has end caps which are formed from folded end portions of the header plate to block fluid from flowing out of the ends of the header.

DETAILED DESCRIPTION OF THE INVENTION

Figure 1:
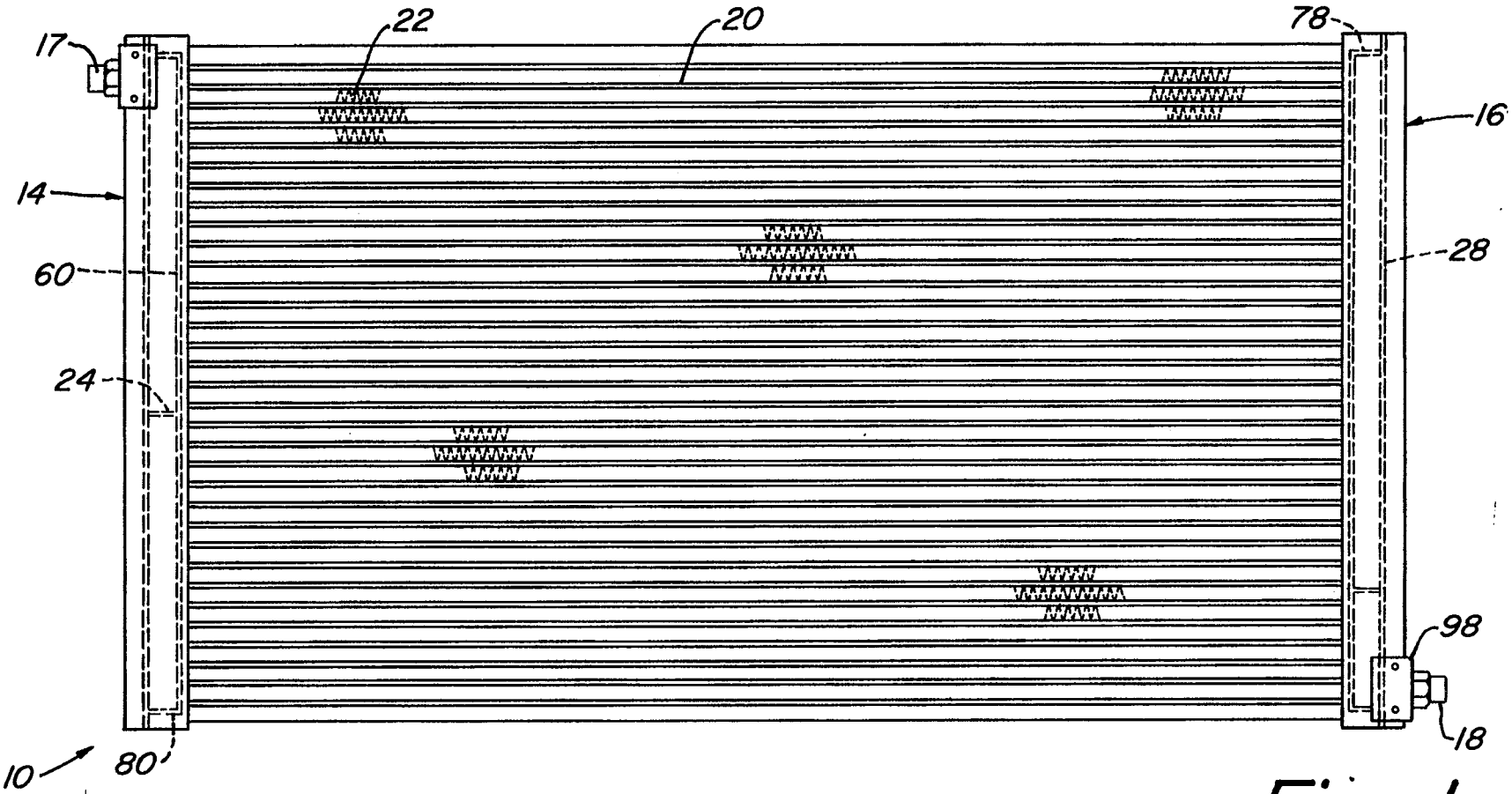
FIG. 1 is a front elevational view of the heat exchanger constructed in accordance with the invention.

Referring to FIG. 1, a parallel flow heat exchanger 10 has a pair of parallel headers 14, 16. The headers 14, 16 are formed from extruded aluminum or aluminum alloy.

An inlet 17 is located on the upper portion of header 14 for introducing heat exchange fluid within the heat exchanger 10. An outlet 18 attached on the lower portion of header 16 allows fluid to flow out of the heat exchanger 10.

Disposed between the headers 14, 16 are a plurality of parallel cross-flow tubes 20. The tubes 20 are substantially flat and are formed by conventional extrusion methods. Each of the tubes has a plurality of flow passages 21, as shown in the cross section of FIG. 2.

Figure 2:
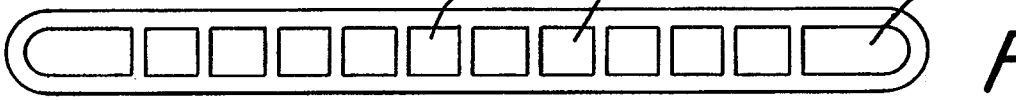
FIG. 2 is a cross-sectional view of a cross-flow tube of the heat exchanger of FIG. 1.

In the embodiment of FIG. 2, the flow passages 21 are substantially rectangular in shape and consist of interior flow passages **21*a* and outer flow passages 21*b* located along the edges. The interior flow passages 21*a* have a hydraulic diameter of 0.0509 inches and the outer flow passages 21*b*** have a hydraulic diameter of 0.0680 inches.

The ends of the tubes 20 extend into and are joined to the headers 14, 16 so that the tubes 20 are in fluid communication with the headers 14, 16, allowing fluid to flow from one header to another.

Fluid partitions 24 are provided in each header 14, 16 for diverting fluid flow through the headers 14, 16 and into the tubes 20.

Located between each of the tubes 20 are corrugated fins 22. The corrugated fins 22 extend along the length of each tube 20. The fins 22 conduct heat away from the tubes 20 and provide an increased surface area for heat to be transferred away by convection. The corrugated fins 22 also provide support between the tubes 20.

Figure 3:
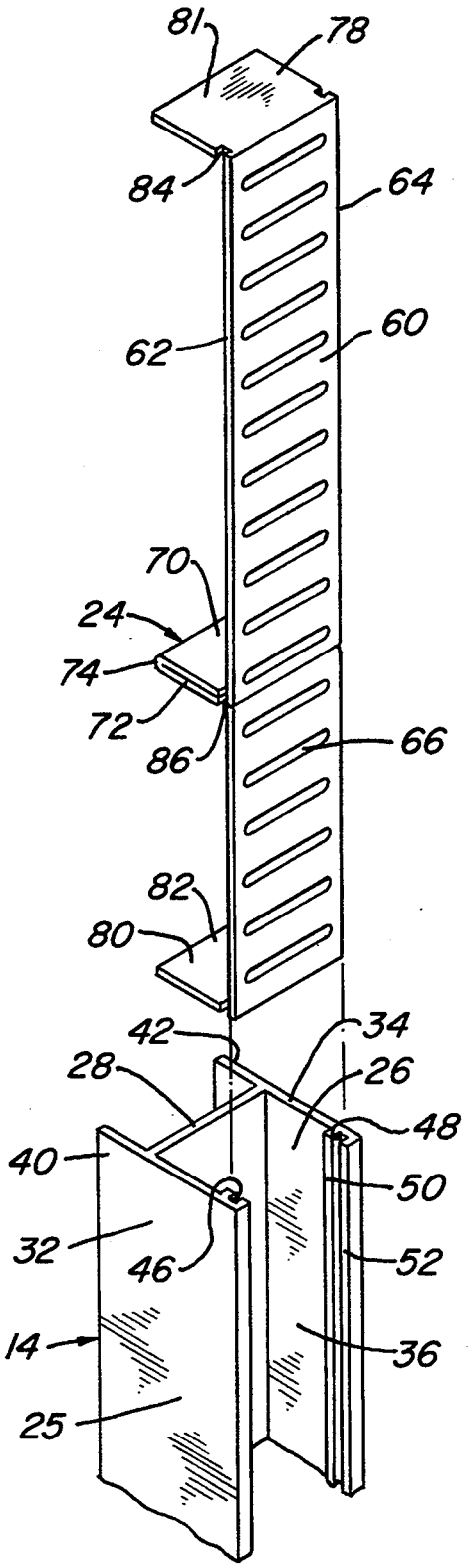
FIG. 3 is a perspective view of the header prior to inserting a header plate into the header channel and constructed in accordance with the invention.

Headers 14, 16 are both constructed similarly, however, for illustrative purposes, only the construction of header 14 is described in detail and shown in FIG. 3. As can be seen, header 14 is formed from a header channel 25. The header channel 25 has a hollow interior 26 defined by a rear wall 28 and parallel, opposite sidewalls 32, 34. The interior 26 has a substantially rectangular cross section. A longitudinally extending open portion 36 extends along the full length of the header channel 25 from one end to the other.

Joined to each sidewall 32, 34 are flanges 40, 42 which extend along the length of header channel 25. The flanges 40, 42 are integrally formed with the sidewalls 32, 34 and extend rearward from the rear wall 28 and opposite the open portion 34. The flanges 40, 42 are coplaner with sidewalls 32, 34 and parallel to each other. Flange 40 is coplaner with sidewall 32 and flange 42 is coplaner to sidewall 34.

A pair of grooves 46, 48 are located along opposite sides of the open portion 36 and extend longitudinally along header channel 25 from one end to the other. Each groove 46, 48 is defined by a pair of protruding ridges 50, 52 located and formed on the interior of each sidewall 32, 34. The ridges 50, 52 also extend longitudinally along header channel 25 from one end to the other.

Figure 4:
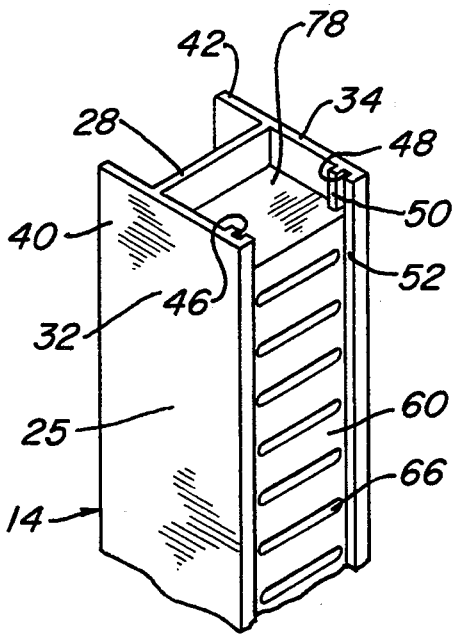
FIG. 4 is the header of FIG. 3 shown with the header plate inserted in the header channel.

In the embodiment of FIGS. 3 and 4, a header plate 60 is formed from a single, flat piece of aluminum. The plate 60 has opposite side edges 62, 64, which extend along the length of the plate 60, and a series of holes 66, which extend along the length of the plate 60 from one end of the header plate 60 to the other between the side edges 62, 64. The header plate 60 has a width that is slightly smaller than the distance between the interior of side walls 32, 34 of the header channel 25.

The fluid partition 24 is formed from a folded portion of the header plate 60 and extends perpendicularly from the plate 60. It should be noted that no holes are formed in the folded portion of the header plate 60 which forms the fluid partition 24. The fluid partition 24 has an upper folded portion 70 and a lower folded portion 72 which are pressed together and joined along an inner edge 74.

Extending perpendicularly from each end of the header plate 60 are end caps 78, 80. The end caps 78, 80 are also formed by folded end portions 81, 82 of the header plate 60. As shown in FIG. 3, there are no holes formed in the end caps 78, 80.

Slots 84 are formed in the edges of the end caps 78, 80 adjacent to the header plate 60. The fluid partition 24 is also provided with similar slots 86 formed in the edges of upper and lower portions 70, 72 where the fluid partition 24 extends from the header plate 60. These slots 84, 86 correspond to the ridge 50 formed on each side wall 32, 34 of the header channel 25 so that the header plate 60 may be inserted into the header channel 25 with the slots 84, 86 receiving the ridge 50.

FIG. 4 illustrates the header 14 after the header plate 60 has been inserted into the header channel 25. The end caps 78, 80 project across the interior 26 of the header channel 25 so that fluid will not flow out the ends of the header 14. The fluid partition 24 also projects into the interior of header channel 25, blocking the interior 26 of header channel 25. With the header plate 60 inserted into header channel 25, the end caps 78, 80 and fluid partition 70 are substantially perpendicular to the header channel 25.

Figure 5:
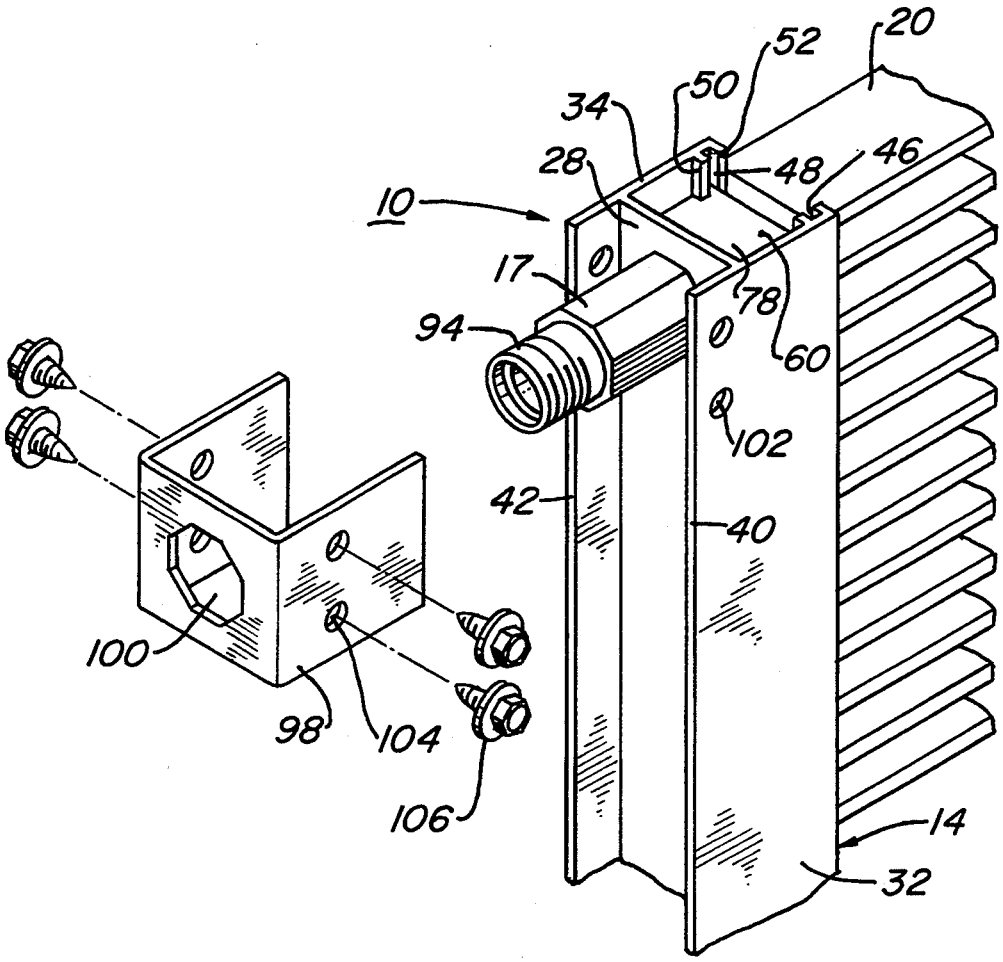
FIG. 5 is a rear perspective view of the header of FIG. 3 shown with a mounting bracket exploded away from the header.

Both the inlet 17 and outlet 18 are constructed similarly. For illustrative purposes, the construction of inlet 17 is described in detail and shown in FIGS. 5 and 6. The inlet 17 consists of a pipe fitting which is joined to the header 14, as shown in FIG. 5, by conventional methods. A threaded portion 94 is located on inlet 17 for coupling to another suitable pipe fitting.

Figure 6:
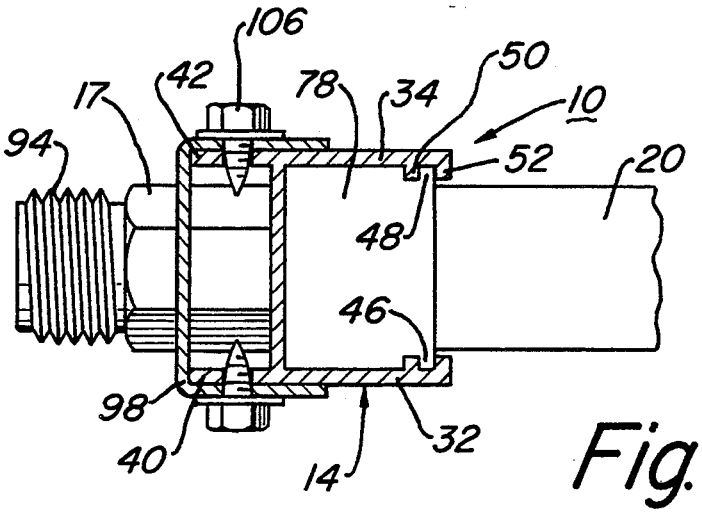
FIG. 6 is a top plan view of the header with the mounting bracket shown attached to the flanges of the header.

A fitting support bracket 98, shown in FIG. 5 exploded away from the header 14, is attached to the flanges 40, 42. The support bracket 98 is provided with an opening 100 for positioning over the inlet fitting 17. Holes 102, 104 on the flanges 40, 42 of the header 14 correspond with holes 104 formed on the support bracket 98. The support bracket 98 is attached by a set of fasteners 106 as shown in FIG. 6, however, the bracket 98 may also be attached by other conventional methods such as brazing.

Because the flanges 40, 42 extend rearward from the header 14, the support bracket 98 can be easily attached without the fasteners 106 interfering with the tubes 20.

The method of forming the heat exchanger 10 is as follows. The header channel 25 is formed from aluminum or aluminum alloy by conventional extrusion methods. The sidewalls 32, 34, flanges 40, 42, open portion 36 and grooves 46, 48 are all formed simultaneously during the extrusion process.

An opening for the inlet 17 and outlet 18 is formed in the rear wall 28 of the header channel 25 of the extruded headers 14, 16. The holes 102 formed on the flanges 40, 42 may also be punched or drilled. Pipe fittings forming the inlet 17 and outlet 18 may be attached to the header 14, 16 by conventional methods with the support brackets 98 being fitted over the inlet 17 and outlet 18 and joined to the flanges 40, 42 by the fasteners 106.

In the embodiment of FIGS. 3 and 4, the header plate 60 is initially formed from a single, flat piece of aluminum by conventional methods, such as extrusion and is clad with a brazing compound. Depending on the number of cross-flow tubes 20 to be incorporated in the heat exchanger 10, the appropriate number of holes 66 are punched or otherwise formed in the header plate 60.

The fluid partition 24 is formed by first cutting the slots 86 in the upper and lower portions 70, 72. The upper and lower portions 70, 72 are then mechanically bent so that the upper and lower portions 70, 72 are folded together and extend perpendicularly from the header plate 60.

The end caps 78, 80 are formed by cutting the slots 84 in end portions 81, 82 and then bending the upper and lower end portions 81, 82 of the header plate 60 so that the end portions 81, 82 extend perpendicularly from the plate 60 and parallel to each other.

Cross-flow tubes 20 may be formed by conventional methods, such as extrusion, and cut to length. The corrugated fins 22 are attached to each of the tubes 20 by brazing or welding. The ends of the tubes 20 are then inserted into the holes 66 of the header plate 60. Heat is applied to the ends of the tubes 20 to melt the brazing compound clad on the header plate 60, thereby joining and sealing the ends of the tubes 20 to the header plate 60.

To assemble the header plate 60 with the header channel 25, the side edges 62, 64 of the header plate 60 slide in grooves 46, 48 from the upper end of the header channel 25 to the lower end as shown by the arrows in FIG. 3. The slots 84, 86 receive the ridge 50 on either side wall 32, 34. When the header plate 60 is inserted into the header channel 25 as described, the header plate extends over the open portion 36 and is retained in place by the grooves 46, 48.

The header plate 60 is clad with a brazing compound along the side edges 62, 64 and along the edges of the fluid partition 24 and end caps 78, 80. By heating the header channel 25 and header plate 60, the brazing compound is melted so that the brazing compound flows by capillary action between the spaces between the header plate 60 and the header channel 25. The header plate 60 and header channel 25 are thus joined and sealed together. The fluid partition 24 and end caps 78, 80 are also joined and sealed to the interior 26 of the header channel 25 in the same manner.

The operation of the heat exchanger 10 is as follows. Fluid, such as refrigerant, is introduced into the heat exchanger 10 through inlet 17. The fluid flows through header 14 until it reaches the fluid partition 24, wherein the fluid is directed through a series of the cross-flow tubes 20 and empties into header 16. By providing a series of fluid partitions 24 throughout each of the headers 14, 16, the fluid can be directed through the cross-flow tubes 20 and headers 14, 16 in a serpentine manner, eventually emptying into the header 16 where the outlet 18 is formed. The fluid then exits the heat exchanger 10 through outlet 18.

By forcing the fluid through the series of cross-flow tubes 20, the fluid is cooled as heat is conducted through the walls of the tubes 20. Heat is also conducted to the corrugated fins 22 which provide additional heat exchange surface for convective heat transfer.

Figure 7:
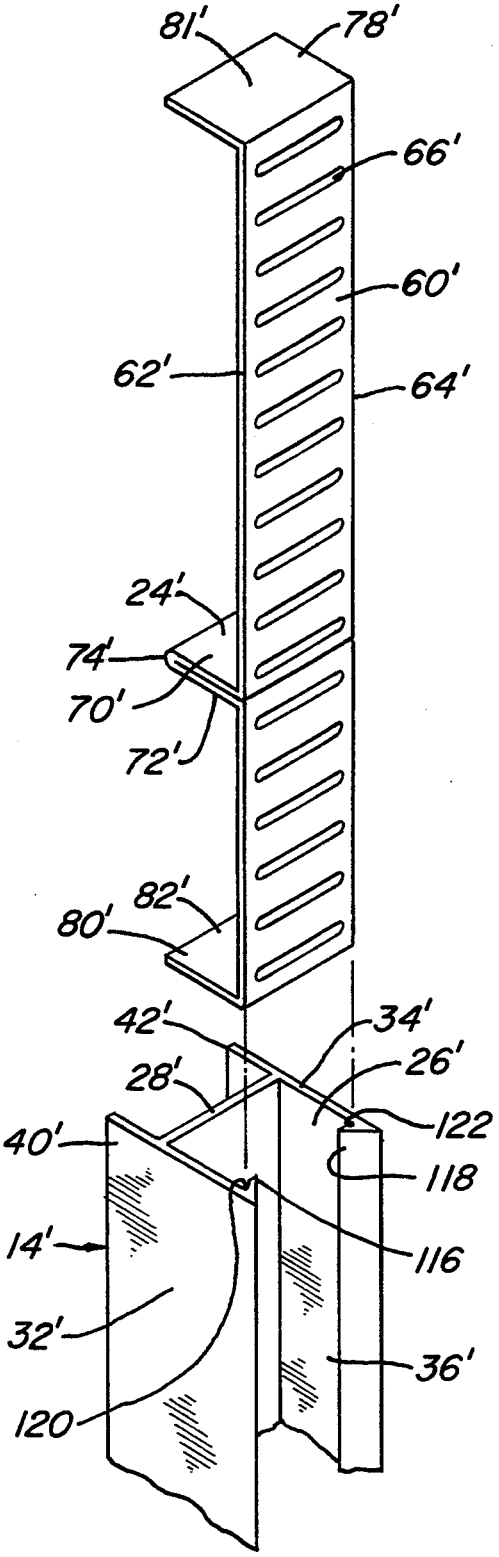
FIG. 7 is an alternate embodiment of the header of the invention showing the header channel and header plate prior to inserting the header plate into the header channel.

In another embodiment of the invention, as shown in FIG. 7, the header 14' is formed in substantially the same manner as header 14. The components of header 14' are similar to those for header 14 in FIG. 3 and are designated by a prime sign. Instead of ridges 50, 52, the header channel 25' is provided with a set of longitudinally extended lips 116, 118 on either side of the open portion 36'. The lips 116, 118 protrude inward towards the interior 26' of the header channel 25' to form a groove 120, 122 on either side of the opening 36'.

Header plate 60' is formed in substantially the same manner as the header plate 60 except slots 84, 86 formed on the end caps 78, 80 and fluid partition 24 of header plate 60 are absent on header plate 60'.

Figure 8:
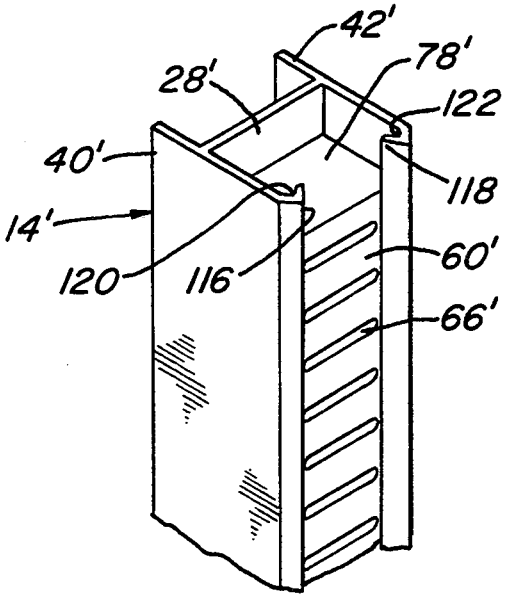
FIG. 8 is a perspective view of the header of FIG. 7 shown with the header plate inserted into the header channel.

The method of forming the header 14' is substantially the same as for header 14. The lips 116, 118 are spaced far enough apart so that the header plate 60' may be slid laterally into the header channel 25'. Alternatively, the header plate 60' may be slid longitudinally into the header channel 25' along the lips 116, 118, as shown by the arrows in FIG. 7. The lips 116, 118 are then mechanically bent inward, as shown in FIG. 8, to retain the header plate 60' within the header channel 25' and to further close the grooves 120, 122. The side edges 62', 64' of the header plate 60' are then brazed to the header channel 25' by heating the header plate 60' so that the brazing compound clad on the header plate 60' flows by capillary action into the grooves 120, 122 and spaces between the header plate 60' and header channel 25'. By closing the grooves 120, 122, the amount of brazing compound necessary to fill the braze gap between the side edges 62', 64' of the header plate 60' and the header channel 25' is minimized.

Figure 9:
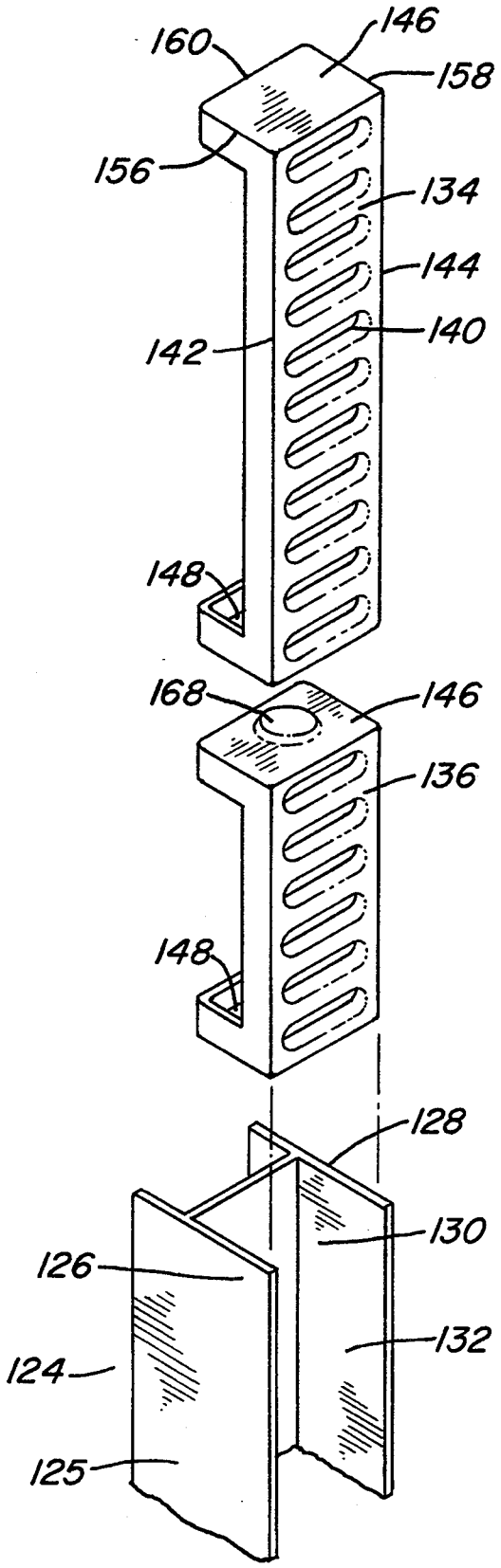
FIG. 9 is a perspective view of another embodiment of the header having two header plates, shown with the header plates prior to inserting into the header channel.
Figure 10:
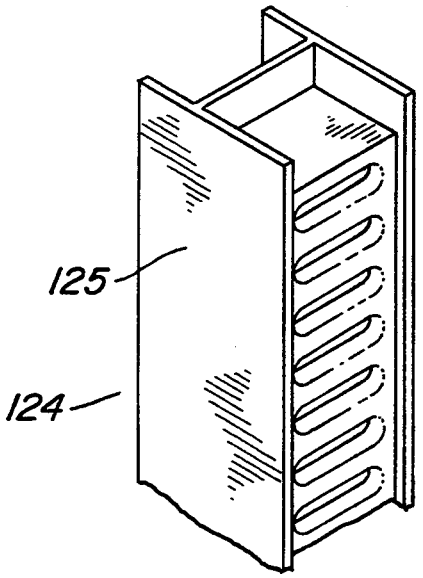
FIG. 10 is a perspective view of the header of FIG. 9 shown with the header plates inserted into the header channel.

In a third embodiment, a header 124 can be formed as shown in FIGS. 9 and 10. Header 124 consists of a header channel 125 having parallel, opposite sidewalls 126, 128. The header channel 125 is substantially the same as header channel 25 of FIG. 3 except there are no grooves or ridges formed on the sidewalls 126, 128. The header channel 125 has a hollow interior 130 and an open portion 132 extending along the length of the header channel 125.

An upper header plate 134 and lower header plate 136 are provided with the header 124. The upper and lower header plates 134, 136 are similar to the header plates 60, 60' of FIGS. 3 and 7 and have a series of holes 140 extending along the length of each plate 134, 136. The combined length of the upper and lower header plates 134, 136 is about equal to the length of the header channel 125. The widths of the header plates 134, 136 are slightly smaller than the distance between the interior of the side walls 128, 130 of the header channel 125.

Each plate 134, 136 has opposite side edges 142, 144 which extend along the length of each plate 134, 136. Upper and lower end caps 146, 148 are integrally formed on the upper and lower ends, respectively, of each header plate 134, 136. The end caps 146, 148 extend perpendicularly from the header plates 134, 136 and are parallel to each other. Each end cap 146, 148 has opposite side edges 156, 158 and an end edge 160.

A continuous, substantially flat web portion 164 is integrally formed and extends from the side edges 142, 144 of the header plates 134, 136, and the side edges 156, 158 and end edge 160 of the end caps 146, 148. The web portion 164 is clad with a brazing compound for joining the header plates 134, 136 to the header channel 125.

Formed on the end cap 146 at the upper end of the lower header plate 136 is a protrusion 168. The protrusion 168 may be of any desired shape.

Figure 11:
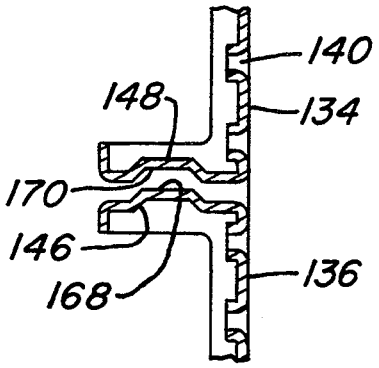
FIG. 11 is a side cross-sectional view of a protrusion and recess formed on the endcaps of the header plates of FIG. 9 and constructed in accordance with the invention.

A recess 170 is formed on the end cap 148 at the lower end of upper header plate 134 as shown in FIG. 11.

To assemble the header 124 as shown in FIG. 10, the header plates 134, 136 are positioned within the header channel 125. This may be accomplished by either sliding the header plates 134, 136 laterally through the open portion 132 or longitudinally as shown by the arrows in FIG. 9. The end caps 146, 148 will project into the interior 130 of the header channel 125.

The end cap 148 on the lower end of the upper plate 134 is positioned adjacent to the end cap 146 on the upper end of the lower header plate 136 within the header channel 125 so that the recess 170 receives the protrusion 168. This helps to align the header plates 134, 136 within the header channel 125 during assembly and also creates an interlocking relationship to improve the structural integrity of the header 124.

It should be noted that the header plates 134, 136 may be moved slightly up or down relative to each other while still maintaining the interlocking relationship of the protrusion 168 and recess 170. This enables the plates 134, 136 to be positioned so that the cross-flow tubes and fins that are joined to each header plate 134, 136 can be properly positioned.

With the header plates 134, 136 positioned within the header channel 125, heat is applied to the header plates 134, 136 to melt the brazing compound on the web portion 164. The web portion 164 provides more surface area for brazing. The brazing compound flows by capillary action in the spaces between the web portion 164 and the header channel 125. This simultaneously joins and seals the header plates 134, 136 to the header channel 125.

The end caps 146, 148 which are positioned adjacent to each other within the header channel 125 function as partitions, such as the partition 24 in FIG. 2, for diverting fluid flow through the header 124. The end cap 146 on the upper end of the upper header plate 134 and the end cap 148 on the lower end of the lower header plate 136 project within the interior 130 of the header channel 125 for capping the ends of header channel 125.

The heat exchanger of the invention has advantages over the prior art heat exchangers. Because the header is formed from only two pieces, the headers can be easily assembled. There is no need to modify the header to accommodate insertion of fluid partitions or endcaps. The fluid partitions and endcaps are easily formed from the header plate itself and therefore there is no need for manufacturing these components separately.

Because the holes are formed in the header plate before it is attached to the header channel, the problems associated with forming the holes on tubular headers are eliminated.

In the header of the third embodiment, several header plates having different standard lengths could be used to form partitions for diverting flow through the header. This provides a simple way to assemble different heat exchangers from standard components each having a different number of flow paths.

While the invention has been shown in only a few of its forms, it should be apparent to those skilled in the art that it is not so limited, but is susceptible to various changes without departing from the scope of the invention.

I claim:

1. A heat exchanger comprising in combination:

a pair of header channels, each header channel having a hollow interior and a longitudinally extending open portion;

a pair of header plates, each header plate being substantially flat and having opposite side edges and a series of holes extending along the length of the plate;

retaining means for securing each header plate to each of the header channels so that the header plate extends over the open portion;

a fluid partition joined to and integral with at least one of the header plates which projects within the interior of at least one of the header channels for diverting fluid flow through the interior of said at least one of the header channels, the fluid partition being formed by a folded portion of said at least one of the header plates; and a plurality of generally parallel tubes having opposite ends, the tubes being disposed between the pair of header channels so that the ends of each tube extend through the holes of each header plate.

2. The heat exchanger of claim 1, wherein:

each of the header plates has opposite ends, and wherein a folded end portion is on each of the ends of each header plate projecting across the interior of each header channel for capping the header channels.

3. The heat exchanger of claim 1, wherein:

the retaining means includes grooves formed in each header channel and extending longitudinally on either side of the open portion for receiving the side edges of the header plates.

4. The heat exchanger of claim 1, wherein:

the retaining means includes inwardly projecting lips extending longitudinally on either side of the open portion of each header channel.

5. The heat exchanger of claim 1, further comprising:

a flange joined to and integrally formed with each of the header channels opposite the open portion for attaching mounting brackets to the heat exchanger.

6. The heat exchanger of claim 5, wherein:

the flange extends along the length of each of the header channels.

7. The heat exchanger of claim 5, wherein:

there are a pair of the flanges on each of the header channels.

8. The heat exchanger of claim 1, wherein:

the interior of each header channel has a substantially rectangular cross-section.

9. A heat exchanger comprising in combination:

a pair of header channels, each header channel having a hollow interior with a rectangular cross section, first and second opposite ends and a longitudinally extending open portion extending the full length between the first and second ends;

a pair of header plates, each header plate being one piece and having opposite side edges and a series of holes extending along the length of the plate;

a pair of grooves extending longitudinally along opposite sides of the open portion of each header channel for securing each header plate to each of the header channels, the opposite side edges of the header plates being located within the grooves so that the header plate extends over the open portion;

a fluid partition formed from a folded portion of at least one of the header plates which projects within and blocks the interior of at least one of the header channels for diverting fluid flow through the interior of said at least one of the header channels; and a plurality of generally parallel tubes having opposite ends, the tubes being disposed between the pair of header channels so that the ends of each tube extend through the holes of each header plate; wherein each of the header plates has opposite ends, and wherein a folded end portion is on each of the ends of each header plate projecting across the interior of each header channel for capping the header channels, and wherein the folded portions forming the fluid partition and end caps are perpendicular to each header channel and parallel to each other.

10. The heat exchanger of claim 9, wherein:

each of the header plates has opposite ends, and wherein a folded end portion is on each of the ends of each header plate projecting across the interior of each header channel for capping the header channels.

11. The heat exchanger of claim 9, further comprising:

a flange joined to and integrally formed with each header channel opposite the open portion for attaching mounting brackets to the header channel.

12. The heat exchanger of claim 11, wherein:

the flange extends along the length of each of the header channels from the first end to the second end.

13. The heat exchanger of claim 11, wherein:
there are a pair of the flanges on each of the header channels.

14. A heat exchanger comprising in combination:
a pair of header channels, each header channel having a substantially rectangular cross section with two side walls, a hollow interior, first and second opposite ends and having a longitudinally extending open portion extending between the first and second ends;
a pair of header plates, each header plate being one piece and substantially flat and having opposite side edges and a series of holes extending along the length of the plate;
a pair of grooves extending longitudinally along opposite sides of the open portion of each header channel for securing each header plate to each of the header channels, the opposite side edges of the header plates being located within the grooves so that the header plate extends over the open portion, the grooves allowing each of the header plates to slide longitudinally into the grooves from the first end to the second end during assembly;
a fluid partition formed from a folded portion of at least one of the header plates which projects into the interior of at least one of the header channels for diverting fluid flow through the interior of said at least one of the header channels;
a folded end portion on each of the ends of each header plate projecting across the interior of each header channel for capping the header channels;
a flange joined to and integrally formed with each sidewall of each header channel opposite the open portion for attaching mounting brackets to the header channel; and
a plurality of generally parallel tubes having opposite ends, the tubes being disposed between the pair of header channels so that the ends of each tube extend through the holes of each header plate.

15. The heat exchanger of claim 14, wherein:
their are a pair of the flanges on each of the header channels, each being coplaner with one of the sidewalls of the header channel.

16. The heat exchanger of claim 14, wherein:
the flange extends along the length of the header channel and is coplanar with one of the sidewalls of the header channel.

17. The heat exchanger of claim 14, wherein:
the folded portions forming the fluid partition and end caps are perpendicular to each header channel and parallel with each other.

18. A heat exchanger comprising in combination:
a pair of header channels, each header channel having a substantially rectangular cross section with two side walls, a hollow interior, first and second opposite ends and having a longitudinally extending open portion extending between the first and second ends;
a pair of header plates, each header plate being substantially flat and having opposite side edges and an upper end and a lower end, each header plate having a series of holes extending along the length of the plate, the header plate being joined to the header channel so that the header plate extends over the open portion;
a pair of end caps integrally formed on the ends of each header plate, each end cap having opposite side edges and an end edge, the end caps projecting into the interior of each header channel for capping the header channels; and
a plurality of generally parallel tubes having opposite ends, the tubes being disposed between the pair of header channels so that the ends of each tube extend through the holes of each header plate.

* * * * *